US008075265B2

(12) United States Patent
Turzig

(10) Patent No.: US 8,075,265 B2
(45) Date of Patent: Dec. 13, 2011

(54) GUIDING DEVICE OF A FLOW MACHINE AND GUIDE VANE FOR SUCH A GUIDING DEVICE

(75) Inventor: Daniela Turzig, Buchholz (DE)

(73) Assignee: MAN Diesel & Turbo SE, Augsburg (DE)

( * ) Notice: Subject to any disclaimer, the term of this patent is extended or adjusted under 35 U.S.C. 154(b) by 537 days.

(21) Appl. No.: 12/309,086

(22) PCT Filed: Oct. 25, 2007

(86) PCT No.: PCT/EP2007/009275

§ 371 (c)(1),
(2), (4) Date: Jan. 6, 2009

(87) PCT Pub. No.: WO2008/052699

PCT Pub. Date: May 8, 2008

(65) Prior Publication Data

US 2010/0061845 A1 Mar. 11, 2010

(30) Foreign Application Priority Data

Oct. 28, 2006 (DE) ..... 10 2006 050 907

(51) Int. Cl.
*F03B 1/00* (2006.01)

(52) U.S. Cl. ..... 415/209.3; 415/191

(58) Field of Classification Search ..... 415/209.1, 415/189, 190, 191, 209.2, 209.3, 209.4
See application file for complete search history.

(56) References Cited

U.S. PATENT DOCUMENTS

| | | | | |
|---|---|---|---|---|
| 3,836,282 | A * | 9/1974 | Mandelbaum et al. | 415/209.4 |
| 3,909,157 | A * | 9/1975 | Wachtell et al. | 415/208.3 |
| 4,141,124 | A * | 2/1979 | Ryan | 29/889.1 |
| 4,643,636 | A * | 2/1987 | Libertini et al. | 415/138 |
| 4,728,258 | A * | 3/1988 | Blazek et al. | 415/137 |
| 5,181,550 | A * | 1/1993 | Blazek et al. | 164/100 |
| 5,474,419 | A * | 12/1995 | Reluzco et al. | 415/209.4 |
| 5,494,404 | A * | 2/1996 | Furseth et al. | 415/209.3 |
| 5,586,864 | A * | 12/1996 | Knorowski et al. | 415/209.2 |
| 5,743,711 | A * | 4/1998 | Fournier et al. | 415/209.2 |
| 5,788,456 | A * | 8/1998 | Maier | 415/190 |
| 5,797,725 | A * | 8/1998 | Rhodes | 415/209.2 |
| 6,409,472 | B1 * | 6/2002 | McMahon et al. | 415/189 |
| 6,494,677 | B1 * | 12/2002 | Grady | 415/209.4 |
| 6,595,747 | B2 * | 7/2003 | Bos | 415/209.4 |
| 7,761,990 | B2 * | 7/2010 | Ellis et al. | 29/889.1 |
| 7,854,583 | B2 * | 12/2010 | Wichmann et al. | 415/1 |

(Continued)

FOREIGN PATENT DOCUMENTS

DE 195 47 653 A1 6/1997

(Continued)

*Primary Examiner* — Ross Gushi
(74) *Attorney, Agent, or Firm* — Cozen O'Connor

(57) ABSTRACT

A guide device for a turbomachine, particularly a steam turbine, with a guide vane ring and a plurality of guide vanes which are fastened to the guide vane ring so as to be distributed along the circumference of the guide vane ring. The guide vane ring has a groove, and the guide vanes also have grooves which are aligned with the groove of the guide vane ring in the assembled state. The guide vanes are fixed in their radial position at the guide vane ring by means of a retaining ring which engages in the groove of the guide vane ring and in the grooves of the guide vanes.

21 Claims, 4 Drawing Sheets

U.S. PATENT DOCUMENTS

| | | | | |
|---|---|---|---|---|
| 7,914,255 | B2 * | 3/2011 | Workman et al. | 415/190 |
| 2006/0188369 | A1 * | 8/2006 | Charier et al. | 415/191 |
| 2007/0237633 | A1 * | 10/2007 | Barnett | 415/209.2 |
| 2008/0019836 | A1 * | 1/2008 | Butz et al. | 416/190 |
| 2010/0061845 | A1 * | 3/2010 | Turzing | 415/191 |

FOREIGN PATENT DOCUMENTS

| | | | |
|---|---|---|---|
| EP | 1 143 108 | | 10/2001 |
| GB | 2 425 155 | | 10/2006 |
| WO | WO 2004/057158 | A1 | 7/2004 |

* cited by examiner

GUIDING DEVICE OF A FLOW MACHINE AND GUIDE VANE FOR SUCH A GUIDING DEVICE

PRIORITY CLAIM

This is a U.S. national stage of application No. PCT/EP2007/009275, filed on 25 Oct. 2007, which claims Priority to the German Application No.: 10 2006 050907.2, filed: 28 Oct. 2006, the contents of both being incorporated here by reference.

BACKGROUND OF THE INVENTION

1. Field of the Invention

The invention is directed to a guide device of a turbomachine and a method for producing a guide device of a turbomachine and a guide vane for a guide device of this kind.

2. Description of the Prior Art

DE 195 47 653 C2 discloses a guide device for a turbomachine, particularly a steam turbine. The disclosed guide device comprises a guide vane ring, and a plurality of guide vanes are fastened to the guide vane ring so as to be distributed along its circumference. The guide vane ring, together with the guide vanes fastened to the guide vane ring, are fastened to a guide vane carrier.

According to DE 195 47 653 C2, the guide vanes are fastened to the guide vane ring in such a way that a through-hole is provided for fixing guide vane feet of the guide vanes in the guide vane ring for every guide vane, which through-hole penetrates the guide vane ring and the guide vane foot and is suited for the lateral insertion of a vane retaining pin extending in axial direction. Fixing the guide vanes to the guide vane ring in this way requires extensive manufacturing resources and elaborate assembly.

SUMMARY OF THE INVENTION

It is an object of the present invention to provide a simpler guide device for a turbomachine.

The guide vane ring has a groove, and the guide vanes likewise have a groove which is aligned with the groove of the guide vane ring in the assembled state. The guide vanes are fixed in their radial position at the guide vane ring by means of a retaining ring which engages in the groove of the guide vane ring and in the grooves of the guide vanes.

The radial fastening of the guide vanes to the guide vane ring is carried out in the guide device by means of a retaining ring which engages in a groove of the guide vane ring and in corresponding grooves of the guide vanes, resulting in a reduced expenditure on manufacturing and assembly. Further, the exchange of guide vanes during repair work or maintenance work on the guide device is facilitated.

BRIEF DESCRIPTION OF THE DRAWINGS

Preferred further developments of the invention are indicated in the subclaims and in the following description. An embodiment example of the invention is described in more detail with reference to the drawings without the invention being limited thereby.

DETAILED DESCRIPTION OF THE PRESENTLY PREFERRED EMBODIMENTS

Figure 1:
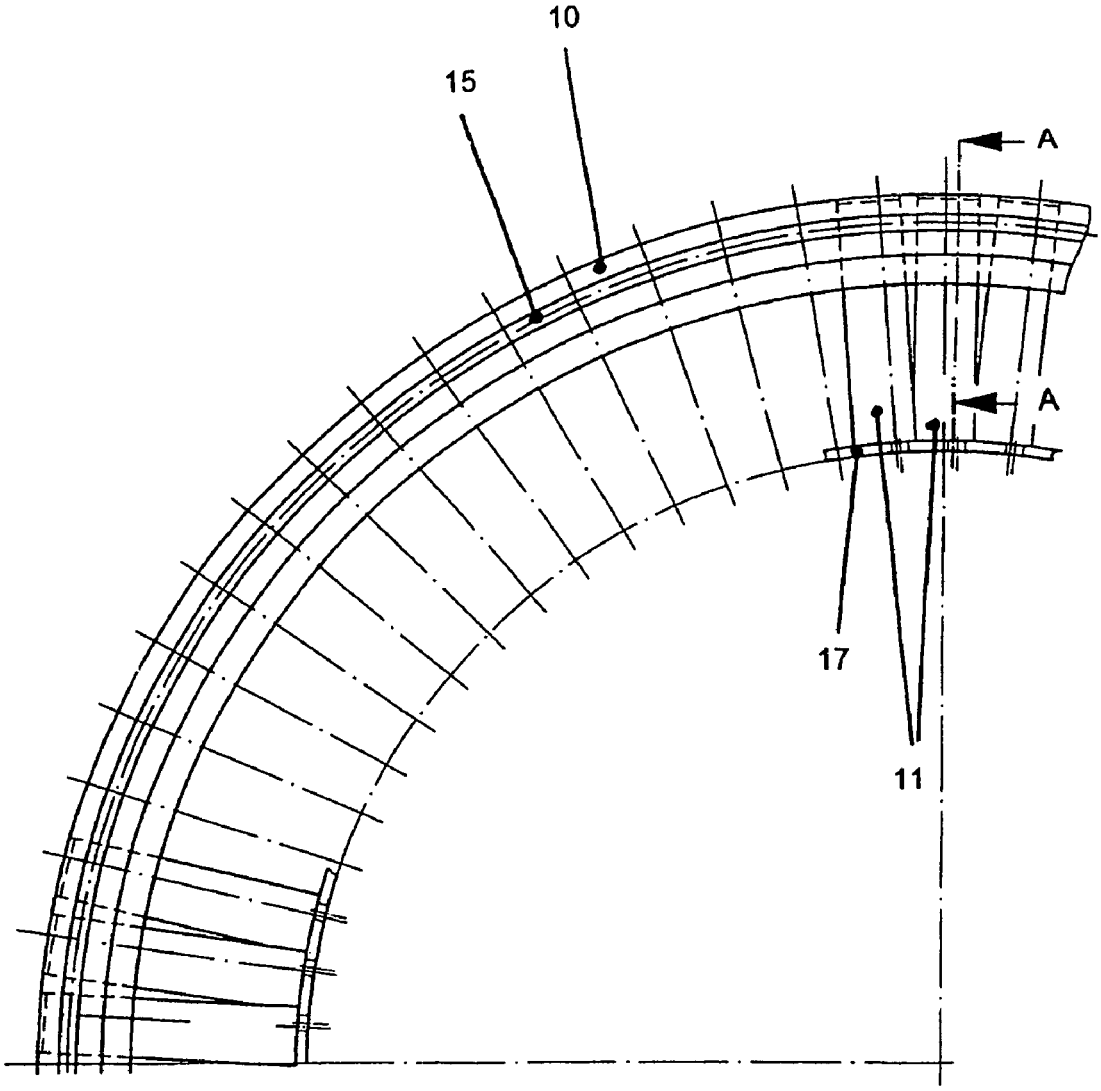
FIG. 1 shows a detail of a guide device according to the invention for a turbomachine.
Figure 4:
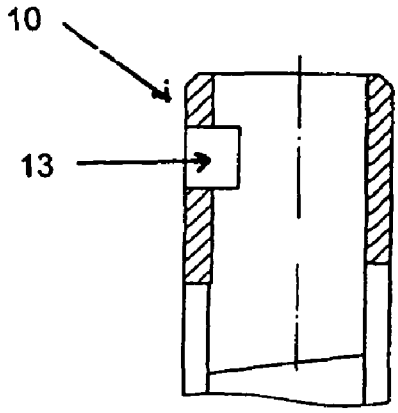
FIG. 4 shows a cross section through the guide vane ring of FIG. 3 in a section direction analogous to section direction A-A in FIG. 1.
Figure 3:
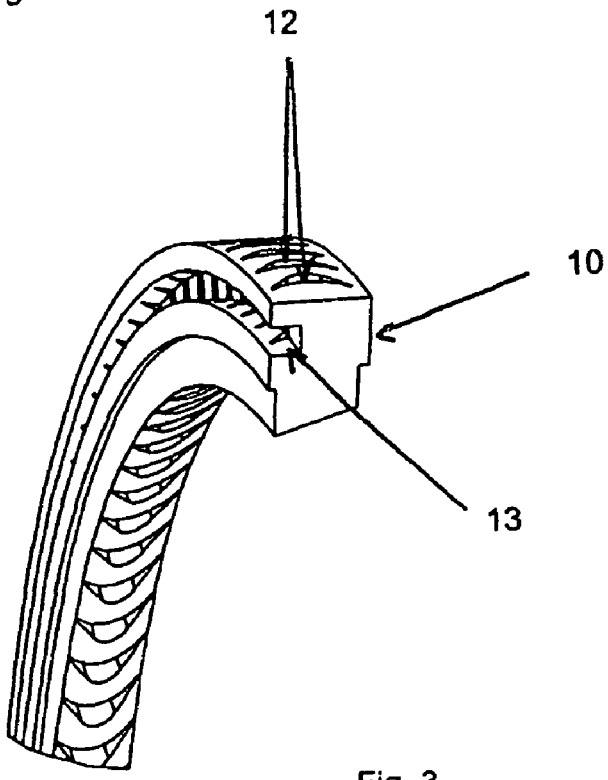
FIG. 3 is a perspective view of a detail of a guide vane ring of the guide device according to the invention.
Figure 5:
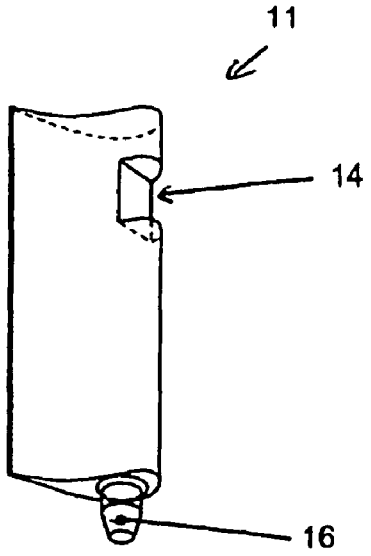
FIG. 5 is a perspective view of a guide vane of the guide device according to the invention.
Figure 6:
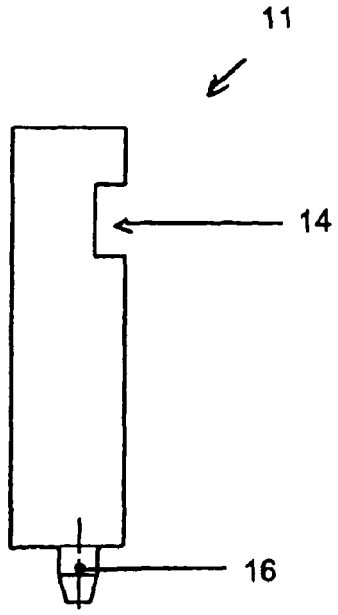
FIG. 6 shows a side view of the guide vanes from FIG. 5.

FIG. 1 shows a detail from a guide device according to one embodiment of the invention in a turbomachine in the region of a guide vane ring 10 and a plurality of guide vanes 11 which are fastened to the guide vane ring 10. FIGS. 3 and 4 show the guide vane ring 10 by itself; FIGS. 5 and 6 show a guide vane 11 also by itself.

The guide vane ring 10 is preferably divided and composed of two halves. According to FIG. 1, the guide vanes 11 are fastened to the guide vane ring 10 at a distance from one another considered in circumferential direction of the same. The guide vanes can be inserted into recesses 12 (see FIG. 3) of the guide vane ring 10 for mounting the guide vanes 11 at the guide vane ring 10. The recesses 12 of the guide vane ring 10 extend in radial direction so that the guide vanes 11 are inserted into the recesses 12 of the guide vane ring 10 from the radial outer side to the radial inner side or, conversely, from the radial inner side to the radial outer side in order to mount the guide vanes 11 on the guide vane ring 10.

In order to fix the guide vanes 11 radially to the guide vane ring 10, a groove 13 extending in circumferential direction of the guide vane ring 10 is incorporated on one side of the guide vane ring 10. Also, a groove 14 is introduced in each guide vane 11 on one side thereof.

The groove 14 of every guide vane 11 is arc-shaped, particularly circular-arc-shaped, and is incorporated in a radial outer end of the same. The groove 13 of the guide vane ring 10 is also arc-shaped, particularly circular-arc-shaped.

A radial inner boundary surface and a radial outer boundary surface of the grooves 13, 14 of guide vane ring 10 and guide vanes 11 are preferably at a distance of between 3 mm and 9 mm from one another, particularly between 4 mm and 8 mm. The radial inner boundary surface and the radial outer boundary surface of the grooves 13, 14 are either flat or are shaped as sections of a cylindrical, conical or toroidal surface.

When the guide vanes 11 are mounted at the guide vane ring 10, the grooves 14 of the guide vanes 11 are aligned with the groove 13 of the guide vane ring 10. A retaining ring 15 which engages in the groove 13 of the guide vane ring 10 and in the groove 14 of the guide vanes 11, as can be seen most clearly in FIG. 2, serves to radially fix the guide vanes 11 to the guide vane ring 10. Accordingly, the guide vanes 11 can be fixed in their radial position to the guide vane ring 10 by the retaining ring 15.

The radial extension of the retaining ring 15 is adapted to the distance between the radial inner boundary surface and the radial outer boundary surface of the grooves 13, 14. Also, the contour of radial boundary surfaces of the retaining ring 15 is adapted to the contour of the radial inner boundary surface and radial outer boundary surface of the grooves 13, 14 so that the radial boundary surfaces of the retaining ring 15 fit against the radial boundary surfaces of the grooves 13, 14 with as little clearance as possible and over the entire surface.

Figure 2:
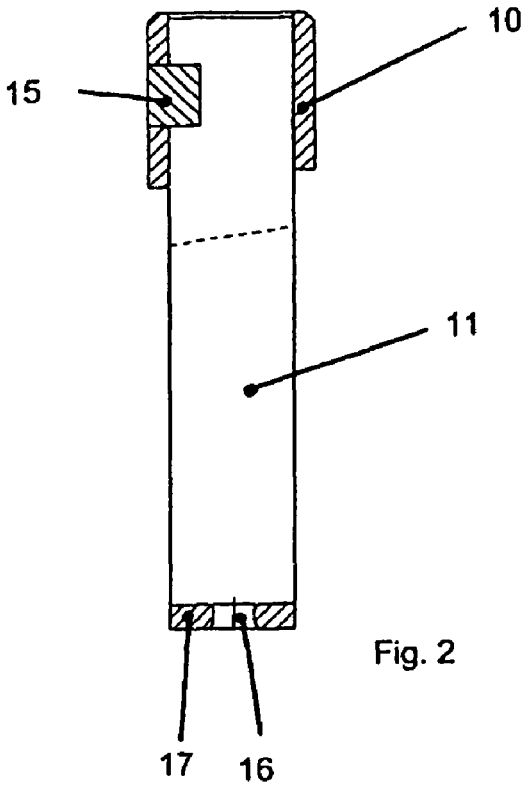
FIG. 2 shows a cross section through the guide device along section direction A-A in FIG. 1.

As can also be seen most clearly from FIG. 2, projections of the guide vanes 11 which are associated with radial inner ends of the guide vanes 11 engage in recesses of an inner shroud 17 of the guide device. However, an inner shroud 17 of this kind is entirely optional. The guide device according to the invention can also be constructed without an inner shroud, in which case the guide vanes have no projections at their radial inner ends.

Figure 7:
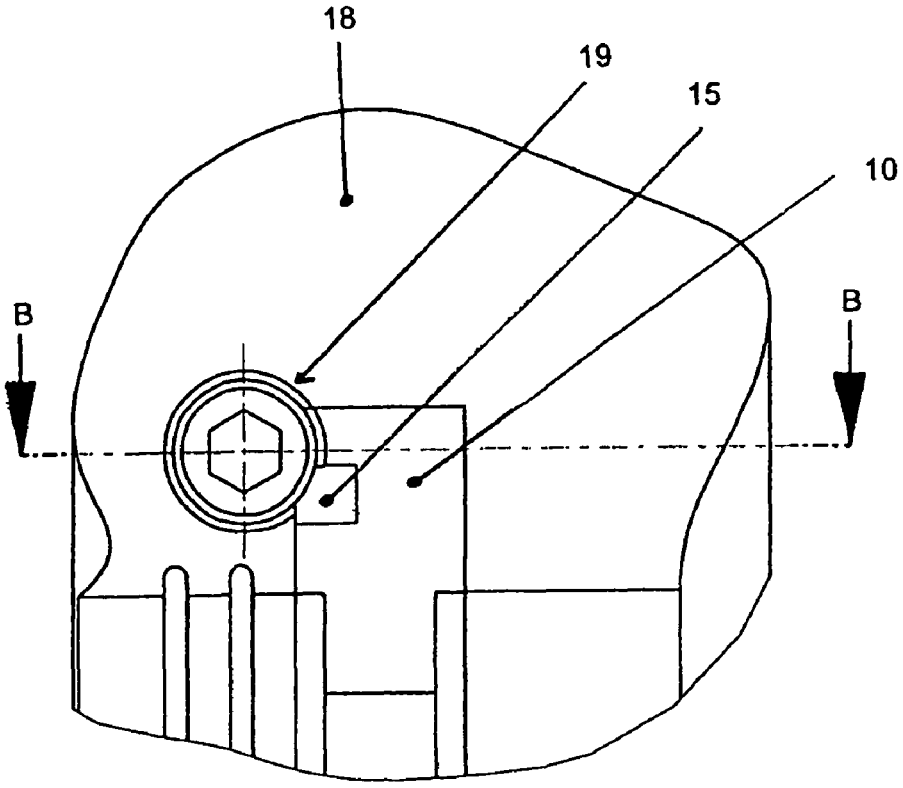
FIG. 7 shows a detail from a guide device according to the invention.
Figure 8:
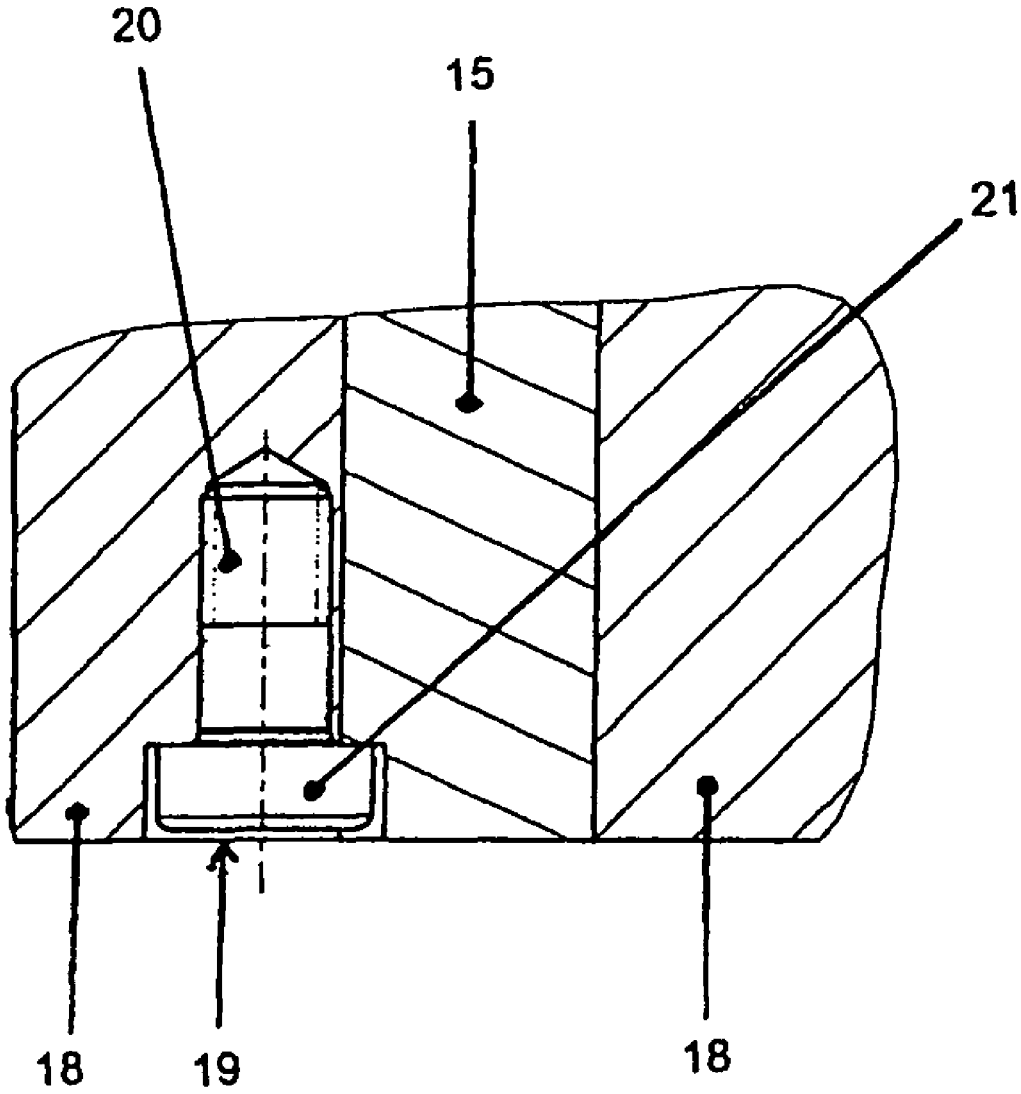
FIG. 8 shows a cross section through the arrangement in FIG. 7 along section direction B-B in FIG. 7.

Referring to FIGS. 7 and 8, the guide vane ring 10 together with the guide vanes 11 fixed at the guide vane ring 10 can be fastened to a guide vane carrier 18, specifically, according to FIGS. 7 and 8, by means of at least one screw 19. According to FIG. 8, the screw 19 engages exclusively in the guide vane carrier 18 by a screw shaft 20, but the screw 19 partially overlaps the vane carrier 18 and vane ring 10 as well as the retaining ring 15 (see FIG. 7) by its screw head 21.

Accordingly, the guide vane ring 10 can be fastened to the guide vane carrier 18 along a circle by means of the screw 19; the screw 19 further serves to fix the retaining ring 15 circularly in the guide vane ring 10. As was already stated, one or more screws 19 of this kind can be arranged so as to be distributed over the circumference of the guide device 10.

Alternatively, the guide vane ring can be fastened to the guide vane carrier and the retaining ring can be fastened to the guide vane ring by a feather key or disk which is held in the guide vane carrier by at least one screw and which covers the three assemblies jointly.

The manufacture and assembly of the guide device according to the invention can be carried out in such a way that groove 13 is incorporated in the guide vane ring 10 and grooves 14 are incorporated in the guide vanes 11 before the guide vanes 11 are fitted to the guide vane ring 10 and, accordingly, can be produced separately.

Groove 13 is preferably incorporated in the guide vane ring 10 by turning or milling and grooves 14 are preferably incorporated in the guide vanes 11 by milling or shaping. Subsequently, the guide vanes 11 can be fastened to the guide vane ring 10 by means of the recesses 12, the retaining ring 15 being inserted into the grooves 13, 14 in axial direction when the grooves 14 of the guide vanes 11 are aligned with the groove 13 of the guide vane ring 10.

Alternatively, the manufacture and assembly of the guide device according to the invention can also be carried out in such a way that grooveless guide vanes 11 can be introduced in a grooveless guide vane ring 10 by means of the recesses 12 and the grooves 13, 14 can then be incorporated jointly in the guide vane ring 10 and guide vanes 11 by turning or milling.

The guide device according to the invention is characterized by a relatively low expenditure on manufacturing and assembly. Further, vanes can be exchanged at the guide device according to the invention in a relatively simple manner.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A guide device for a turbomachine, comprising:

a guide vane ring having a groove;

a plurality of guide vanes, each of the plural guide vanes having a groove, the plural guide vanes fastened to the guide vane ring and distributed along a circumference of the guide vane ring, wherein the guide vane grooves are aligned with the guide vane ring groove; and a retaining ring engaged in each of the guide vane grooves and the guide vane ring groove, the retaining ring fixing each of the plural guide vanes in a radial position on the guide vane ring.

2. The guide device according to claim 1, wherein the groove of the guide vane ring is on a lateral side of the guide vane ring, each of the grooves of the plural guide vanes are on a lateral side of the guide vanes on one side of the plural guide vanes, and the retaining ring is adapted for insertion in an axial direction into the groove of the guide vane ring and into each groove of the plural guide vanes.

3. The guide device according to claim 2, further comprising a guide vane carrier, wherein the guide vane ring is fastened to the guide vane carrier and the plural guide vanes, each of the plural guide vanes fixed to the guide vane ring in a respective radial position.

4. The guide device according to claim 3, wherein the guide vane ring is fastened to the guide vane carrier by at least one screw.

5. The guide device according to claim 4, wherein the at least one screw engages the guide vane carrier by a screw shaft and a screw head partially overlap the guide vane carrier, the guide vane ring, and the retaining ring.

6. The guide device according to claim 1, wherein the groove of the guide vane ring and each of the grooves of the plural guide vanes are arc-shaped.

7. The guide vane according to claim 6, wherein the groove of the guide vane ring and each of the grooves of the plural guide vanes are each circular-arc-shaped.

8. The guide device according to claim 1, wherein a radial inner boundary surface and a radial outer boundary surface of the groove of the guide vane ring and each of the grooves of the plural guide vanes are at a distance of between 3 mm and 9 mm.

9. The guide device according to claim 8, wherein a radial inner boundary surface and a radial outer boundary surface of the groove of the guide vane ring and each of the grooves of the plural guide vanes are flat.

10. The guide device according claim 8, wherein a radial inner boundary surface and a radial outer boundary surface of the groove of the guide vane ring and each of the grooves of the plural guide vanes are each shaped as at least one of a section of a cylindrical, conical, and toroidal surface.

11. The guide device according to claim 8, wherein a radial inner boundary surface and a radial outer boundary surface of the groove of the guide vane ring and each of the grooves of the plural guide vanes are at a distance of between 4 mm and 8 mm.

12. The guide device according to claim 1, wherein the groove is incorporated in the guide vane ring by turning or milling and grooves are incorporated in the each of the plural guide vanes by shaping or milling.

13. The guide device according to claim 12, wherein the grooves are incorporated in the each of the plural guide vanes before fitting the guide vanes to the guide vane ring.

14. The guide device according to claim 12, wherein the grooves are incorporated in the each of the plural guide vanes after fitting the guide vanes to the guide vane ring.

15. The guide device according to claim 1, wherein the groove is incorporated in the guide vane ring by turning or milling and the grooves of each of the plural guide vanes are incorporated in the guide vanes jointly by turning or milling prior to fitting the guide vanes to the guide vane ring.

16. The guide vane or guide device according to claim 1, further comprising an arc-shaped groove in a radial outer end of the guide vane.

17. The guide vane according to claim 16, wherein a radial inner boundary surface of the groove and a radial outer boundary surface of the arc-shaped groove are at a distance of between 3 mm and 9 mm.

18. The guide vane according to claim 16, wherein a radial inner boundary surface of the groove and a radial outer boundary surface of the arc-shaped groove are flat.

19. The guide vane according to claim 16, wherein a radial inner boundary surface of the arc-shaped groove and a radial outer boundary surface of the arc-shaped groove are shaped as sections of at least one of a cylindrical, conical, and toroidal surface.

20. The guide vane according to claim 1, wherein the turbomachine is a steam turbine.

21. A method for producing guide device for a turbomachine, the guide device comprising:

a guide vane ring having a groove;

a plurality of guide vanes, each of the plural guide vanes having a groove, the plural guide vanes fastened to the guide vane ring and distributed along a circumference of the guide vane ring, wherein the guide vane grooves are aligned with the guide vane ring groove; and a retaining ring engaged in each of the guide vane grooves and the guide vane ring groove, the retaining ring fixing each of the plural guide vanes in a radial position on the guide vane ring, wherein the method comprises:

at least one turning and milling the groove in the guide vane ring; and at least one of shaping grooves in the each of the plural guide vanes, milling grooves in the each of the plural guide vanes, milling the grooves of each of the plural guide vanes prior to fitting the guide vanes to the guide vane ring, and turning the grooves of each of the plural guide vanes prior to fitting the guide vanes to the guide vane ring.

* * * * *